United States Patent [19]

Stanley

[11] 4,080,411

[45] Mar. 21, 1978

[54] SLURRY-CAST PROPELLANT METHOD

[75] Inventor: Norval F. Stanley, La Vale, Md.

[73] Assignee: Hercules Incorporated, Wilmington, Del.

[21] Appl. No.: 754,409

[22] Filed: Aug. 21, 1968

[51] Int. Cl.[2] ..... C06B 21/00

[52] U.S. Cl. ..... 264/3 B; 264/3 C; 149/2; 149/97; 149/98

[58] Field of Search ..... 149/2, 97, 98; 264/3 B, 264/3 C

[56] References Cited

U.S. PATENT DOCUMENTS

| | | | |
|---|---|---|---|
| 3,163,567 | 12/1964 | Silk | 149/97 X |
| 3,422,169 | 1/1969 | Brooks et al. | 149/2 X |

*Primary Examiner*—Stephen J. Lechert, Jr.
*Attorney, Agent, or Firm*—Michael B. Keehan

[57] ABSTRACT

A process is provided for preparing double base propellant by slurry casting in which flake casting powder is employed as the source of nitrocellulose. High burning rate propellants can be prepared by this process employing flake casting powder containing ballistic modifiers.

11 Claims, 2 Drawing Figures

Figure 1:
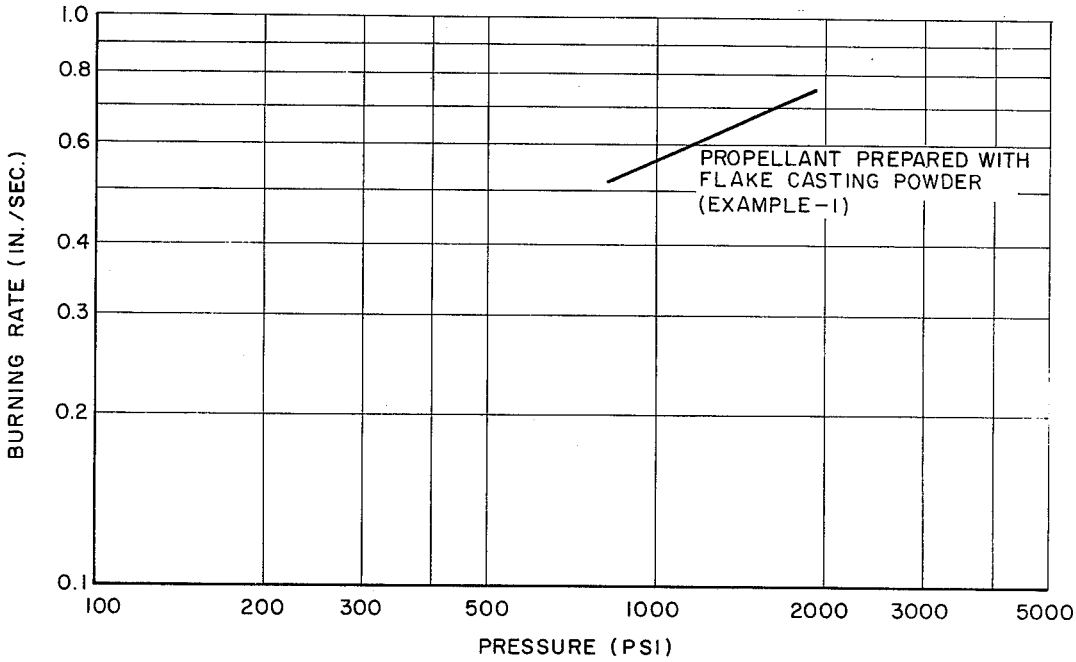

NORVAL F. STANLEY
INVENTOR.

BY Michael B. Keehan

ATTORNEY

SLURRY-CAST PROPELLANT METHOD

This invention relates to a process for preparing high burning rate propellant by a slurry casting process. More particularly this invention relates to a process for preparing double base propellant by slurry casting, in which flake casting powder is employed as the source of nitrocellulose.

Large double base propellant grains are presently prepared by two processes, conventional or "in-situ" casting and "slurry casting". Each of these processes has advantages depending on the desired properties of the final propellant.

In the "in-situ" casting process, casting powder granules comprised of precolloided nitrocellulose are charged to a mold and covered with a casting liquid. The casting powder granules absorb the casting liquid and swell to form a consolidated mass. The casting powder granules are prepared by a solvent process in which fibrous nitrocellulose is dissolved in or colloided by the addition of a volatile solvent such as acetone or ether-alcohol, and by mixing the nitrocellulose until a viscous mass is obtained. Burning rate modifiers and other solid adjuvants as well as energetic plasticizers are readily admixed with the viscous propellant mass. This process is particularly advantageous for preparing high burning rate propellant containing ballistic modifiers, since the ballistic modifiers can be suspended and uniformly distributed throughout the viscous propellant mass. The propellant mass is granulated by suitable means and the volatile solvent removed.

In the slurry casting process a pourable slurry of propellant ingredients is prepared, and the slurry is cast into a mold and cured. Slurry casting processes presently employ nitrocellulose in the form of tiny densified particles having a hard, dense outer shell which resists attack by nitroglycerin at processing temperatures. These tiny densified particles of nitrocellulose are sometimes referred to as plastisol forms of nitrocellulose.

Advantages of the "slurry casting" process over "in-situ" methods are relatively short cure times, low processing costs, and adaptability of the process to include highly energetic and sensitive propellant ingredients in the propellant formulation because of relatively mild mixing conditions of the slurry process. Furthermore, double base slurry cast propellant in which a crosslinking agent is included has, in general, superior low temperature mechanical properties to that of a similar in-situ cast propellant. The chief disadvantage of slurry casting processes has been due to the high cost of suitable densified nitrocellulose particles, and the inability to uniformly disperse ballistic modifiers in the propellant prepared employing these densified particles of nitrocellulose, thus limiting burning rate modification of the propellant produced thereby.

Now, in accordance with this invention, a process has been discovered which combines the attributes of both in-situ cast propellants and slurry cast propellants. This process employs flake casting powder as the source of nitrocellulose in the propellant. The flake casting powder employed can contain those adjuvants which cannot satisfactorily be incorporated into slurry cast propellant employing densified nitrocellulose particles due to settling of these adjuvants during the curing step of the process. The process of this invention comprises mixing a casting liquid, and flake casting powder to form a pourable slurry, casting the slurry, and curing the cast slurry to form a consolidated propellant charge having uniform distribution of ingredients throughout.

Figure 2:
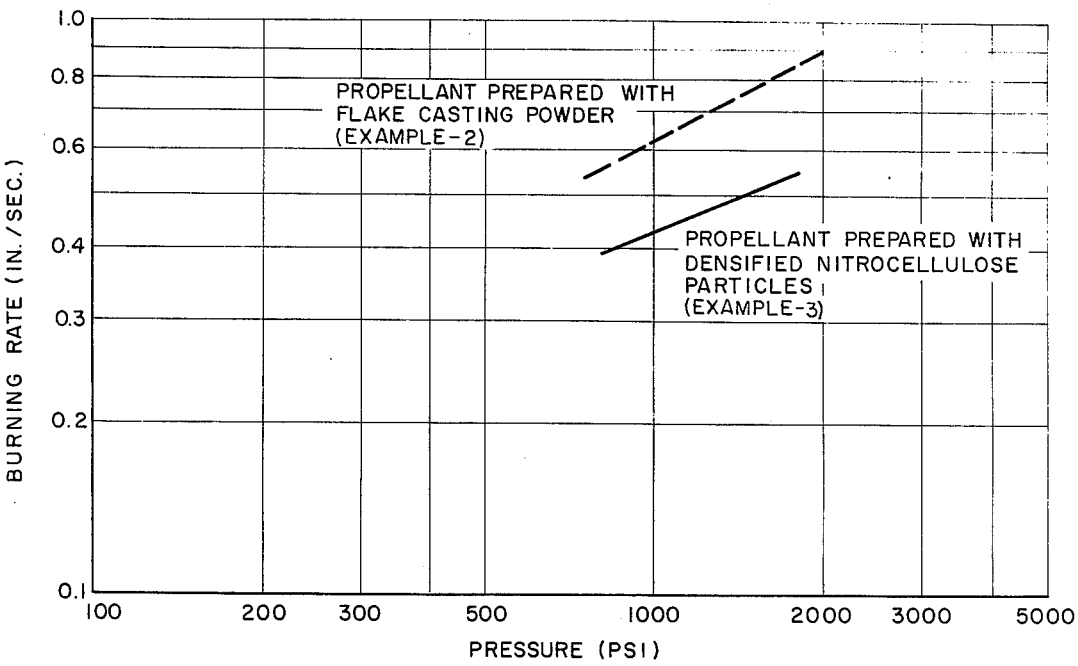

A log-log plot of burning rate versus pressure of propellant manufactured in accordance with the process of this invention using flake casting powder is illustrated in the drawings, in which FIG. 1 represents a propellant manufactured in accordance with the process of this invention (Example 1) and FIG. 2 represents a comparison of burning rate data for propellants of this invention (Example 2) with similar propellant manufactured by prior art methods (Example 3).

The flake casting powder which is employed in the process of this invention is comprised of nitrocellulose and is prepared by the solvent process for manufacture of casting powder heretofore briefly described. In the granulation step of the solvent process the viscous propellant mass prepared is pressed into a block at about 2000–4000 psi and then extruded into small strands of propellant of circular cross-section. These small strands are cut into flakes, dried to remove all solvent, glazed, screened to proper size and blended. In the process described, uniform distribution of ballistic modifiers such as lead $\beta$-resorcylate and lead salicylate in the propellant mass is readily accomplished in the mixing process.

Flake size is determined by the diameter of the propellant strand produced during extrusion of the blocked propellant and the number of cuts made per lineal inch of strand. Flakes in the form of thin discs having a thickness of from about 3 mils to about 10 mils and a diameter of from about 25 mils to about 60 mils are generally suitable for use in the process of this invention. Preferred size ranges for the flake are thicknesses of from about 3 mils to about 5 mils and diameters of from about 25 mils to about 35 mils. While flakes are generally prepared in the form of thin discs, other shapes and configurations can be employed. For example, the flake in the form of a thin disc can have one or more perforations if desired.

Flake size is important in determining whether a pourable slurry can be prepared and if the propellant resulting upon cure is of uniform composition. Flakes employed that are too large will settle during curing of the slurry resulting in a propellant of nonuniform composition. Flakes employed that are too small result in a slurry which becomes too viscous to cast prior to adequate mixing of the slurry ingredients. This increase in viscosity of the slurry employing small flake having a thickness of less than about 3 mils is a result of rapid absorption of the casting liquid by the flake because of the high surface area per unit weight of nitrocellulose in the flake.

The ratio of liquid to solid is also important in preparing a pourable slurry employing flake casting powder. In general the slurry should contain at least about 50% by weight of liquid and can contain as high as 80% by weight liquid. As the liquid content of a propellant slurry increases over 50% by weight the maximum flake size which can be employed must be reduced to sustain a processible slurry viscosity in the range of from about 10,000 to about 100,000 centipoises, and thereby avoid any settling of the flake casting powder during cure. It is readily apparent that for any given propellant formulation, the percentage of liquid in the slurry governs the flake size to be employed. Other factors such as mixing time and temperature will also effect slurry viscosity and must be considered. It is within the knowledge of those skilled in the art to adjust flake size and mixing conditions to prepare a slurry of satisfactory viscosity for casting.

Casting liquids which can be employed in the process of this invention are plasticizers for nitrocellulose. Any liquid plasticizer which is compatible with nitrocellulose and which gels nitrocellulose by virtue of its solvent or swelling action can be employed. Illustrative plasticizers which are high energy plasticizers for nitrocellulose are nitroglycerin and other nitrate esters such as butane triol trinitrate, diethylene glycol dinitrate, the nitrate esters of pentaerythritol, mixtures thereof, and the like. These casting liquids can be mixed with or without one or more low energy plasticizers for nitrocellulose if desired. Illustrative low energy plasticizers are triacetin, tripropionin, dibutyl phthalate, dinormalpropyl adipate, diethyl phthalate, dibutyl sebacate, and the like.

The composition of the casting slurry can be varied widely depending on the overall ballistic and mechanical properties desired in the cured propellant grain. The flake casting powder content of slurry may range from about 20 to about 50% by weight of the slurry. The flake casting powder can contain from about 10 to about 100% nitrocellulose.

Typical ballistic modifiers which can be incorporated into the flake casting powder and which are uniformly dispersed in the slurry with the flake include lead salts such as lead β-resorcylate, lead salicylate, lead stearate, lead stannate, red lead ($Pb_3O_4$), lead sulfite, and the like. Mixtures of ballistic modifiers can be employed as desired to obtain optimum burning rates for the propellant.

It is often desirable to include a crosslinking component in the slurry process of this invention to improve propellant mechanical properties. Crosslinking components can be admixed in the slurry to give the cured propellant improved mechanical properties. Illustrative crosslinking agents are the isocyanates such as the alkane diisocyanates including ethylene diisocyanate, trimethylene diisocyanate, hexamethylene diisocyanate; the aromatic diisocyanates such as m-phenylene diisocyanate, p-phenylene diiosocyanate, 2,4-tolylene diisocyanate, 2,6-tolylene diisocyanate and 4,4'-diphenylmethane diisocyanate; the prepolymers of hydroxyterminated polyesters with aromatic or aliphatic diisocyanates such as the prepolymers of polyesters obtained from the reaction of polyethylene-glycol, polypropylene-glycol, or polybutylene-glycol, with succinic acid, adipic acid or sebacic acid with 2,4-tolylene diisocyanate; and the like. A preferred crosslinking component is the prepolymer of polyethylene glycol adipate and tolylene diisocyanate referred to sometimes hereinafter as PGA-TDI.

The crosslinking component is generally employed in an amount of from about 5% to about 15% by weight based on the weight of the propellant slurry. The crosslinking component crosslinks the hydroxyl groups of the nitrocellulose, during curing of the slurry thereby improving the mechanical properties of the resulting propellant.

The following examples will further illustrate this invention. All parts and percentages are by weight unless otherwise specified.

EXAMPLE 1

Casting powder is prepared as follows. About 14.5 parts of fibrous nitrocellulose and 14.5 parts of a solvent mixture comprised of ether, ethyl alcohol and acetone in a ratio of 60:35:5 are admixed and a viscous propellant mass results. To this viscous propellant mass is added 9.86 parts of nitroglycerin, 2.0 parts each of lead β-resorcylate and lead salicylate, .35 parts of carbon black and .29 parts of 2-nitrodiphenylamine. The resulting doughy mass of casting powder is extruded into strands of circular cross-sections having a diameter of about 30 mils. These strands are cut into flakes having a thickness of about 3 mils. The flakes are dried, glazed and blended. The flake casting powder has the following formulation (solvent free basis).

| Ingredient | % |
|---|---|
| Nitrocellulose | 50.0 |
| Nitroglycerin | 34.0 |
| Lead β-Resorcylate | 6.9 |
| Lead Salicylate | 6.9 |
| Carbon Black | 1.2 |
| 2-Nitrodiphenylamine | 1.0 |

A pourable propellant slurry is prepared by admixing 29 parts of flake casting powder having the above formulation with a casting solvent comprised of 46.1 parts of nitroglycerin, 9.7 parts of polyglycol adipate-tolylene diisocyanate prepolymer, available commercially and having a molecular weight of 2000 and containing 3.5% isocyanate groups, 10 parts RDX (cyclotrimethylene trinitramine), 4.6 parts dinormal propyl adipate and 0.7 parts of 2-nitrodiphenyl amine. The initial slurry is comprised of about 60.3% free liquid. The slurry is mixed slowly under a reduced pressure of 10 mm. Hg. for about 30 minutes at about 25°C. The resulting pourable slurry is cast into molds under a reduced pressure of about 10 mm. Hg and cured for 5–7 days at 140° C.

The resulting propellant has the following composition:

| Ingredient | Weight % |
|---|---|
| Nitrocellulose | 14.5 |
| Nitroglycerin | 55.9 |
| Lead β-Resorcylate | 2.0 |
| Lead Salicylate | 2.0 |
| Carbon Black | 0.3 |
| 2-Nitrodiphenylamine | 1.0 |
| RDX (cyclotrimethylene trinitramine) | 10.0 |
| Di-normal Propyl Adipate | 4.6 |
| PGA-TDI (prepolymer) | 9.7 |

Strands of the propellant are cut from the cured propellant charge and burned in a strand burning apparatus. A graph of the log of burning rate versus log of the pressure of the propellant is illustrated in FIG. 1. This curve illustrates uniform distribution of ballistic modifier as well as the high degree of ballistic modifier dispersion in the cured propellant.

EXAMPLE 2

Following the processing procedures set forth in Example 1, flake casting powder is prepared having the following composition:

| Ingredient | Weight % |
|---|---|
| Nitrocellulose | 55.0 |
| Nitroglycerin | 23.2 |

-continued

| Ingredient | Weight % |
|---|---|
| Lead β-Resorcylate | 9.9 |
| Lead Salicylate | 9.9 |
| Carbon Black | 1.0 |
| 2-Nitrodiphenylamine | 1.0 |

A pourable propellant slurry is then prepared following the procedures of Example 1. The slurry is comprised of about 50% liquid. The slurry is cast under a vacuum of about 10 mm. Hg and cured at 140° F. for about 5 days. This pourable slurry has the following composition:

| Ingredient | Weight % |
|---|---|
| Nitrocellulose | 11.1 |
| Nitroglycerin | 41.4 |
| Lead β-Resorcylate | 2.0 |
| Lead Salicylate | 2.0 |
| Carbon Black | 0.2 |
| 2-Nitrodiphenylamine | 1.0 |
| Di-Normal propyl adipate | 4.9 |
| Crosslinking Prepolymer (PGA-TDI) | 7.4 |
| RDX (cyclotrimethylene trinitramin | 30.0 |

Strands of propellant are cut from the cured propellant charge and burned in a strand burning apparatus. A graph of the log of the burning rate versus the log of the pressure recorded during burning is illustrated in FIG. 2. This curve illustrates uniform distribution of ballistic modifier and a high degree of dispersion of the ballistic modifier in the cured propellant.

EXAMPLE 3

A propellant of identical overall composition to that of Example 2 is prepared employing a plastisol form of nitrocellulose (a densified small particle nitrocellulose) in place of the flake casting powder. The slurry is prepared employing conventional slurry techniques with all other ingredients including the lead salts added to the slurry mixture. The slurry is cast under a vacuum of about 10 mm. Hg and cured at 140° F. for five days. Strands of propellant are cut from the cured propellant and burned in a strand burning apparatus. The burning rate for the propellant prepared with tiny densified nitrocellulose particles as the source of nitrocellulose is substantially lower than the burning rate of the propellant prepared from the flake casting powder. The burning rate data for both propellants is plotted on FIG. 2 for comparison purposes. The burning rate increase of the propellant prepared employing flake casting powder is about 42% at 1000 psi.

As illustrated by the foregoing examples, it is possible to prepare propellants by slurry casting techniques employing flake casting powder as the source of nitrocellulose. Ballistic modifiers can be uniformly dispersed throughout the propellant employing the process of this invention resulting in higher burning rate propellants prepared by the slurry process than were heretofore possible. The process provides high burning rate propellant not heretofore available except by in-situ casting and having superior mechanical properties to in-situ cast propellant when crosslinked as previously described. This process is also adaptable for use in incorporating very sensitive materials into propellant not possible by in-situ casting methods because of the relatively vigorous processing conditions involved.

As will be evident to those skilled in the art, various modifications can be made or followed, in light of the foregoing disclosure and discussion without departing from the spirit or scope of the disclosure or from the scope of the claims.

What I claim and desire to protect by Letters Patent is:

1. A process for preparation of double base slurry-cast propellants employing flake casting powder as the source of nitrocellulose, said process comprising (a) admixing fibrous nitrocellulose and a volatile solvent therefor to form a viscous propellant mass,
(b) blocking the viscous propellant mass,
(c) extruding the blocked propellant mass into strands of propellant,
(d) cutting the propellant strands into flakes of casting powder,
(e) drying the flakes of casting powder to remove the volatile solvent therefrom,
(f) admixing the dried flake casting powder and a casting liquid to form a pourable slurry,
(g) pouring the pourable slurry into a mold, and
(h) curing the cast slurry to form a consolidated double base propellant charge.

2. The process of claim 1 in which the flake casting powder is prepared in the form of thin discs having a diameter of from about 25 mils to about 60 mils and a thickness of from about 3 mils to about 10 mils.

3. The process of claim 2 in which the flake casting powder is comprised of nitrocellulose and at least one ballistic modifier.

4. The process of claim 3 in which the pourable slurry contains a crosslinking component for nitrocellulose.

5. The process of claim 4 in which the casting liquid is comprised of nitroglycerin.

6. The process of claim 5 in which the crosslinking component for nitrocellulose is a diisocyanate.

7. The process of claim 4 in which the casting liquid is comprised of nitroglycerin and dinormalpropyl adipate.

8. The process of claim 5 in which the crosslinking component is the prepolymer of polyglycol adipate-tolylene diisocyanate.

9. The process of claim 8 wherein the ballistic modifier is lead β-resorcylate.

10. The process of claim 8 wherein the ballistic modifier is lead salicylate.

11. The process of claim 5 in which the pourable slurry comprises by weight from about 50 to about 80% casting liquid, and from about 20 to about 50% flake casting powder.

* * * * *